United States Patent [19]

Retief et al.

[11] 4,293,134

[45] Oct. 6, 1981

[54] TOY

[76] Inventors: Andries Retief, 207 Nedholm Flats, Devenish St., Sunnyside, Pretoria; Gert J. Zovitsky, 220 Upingtonia Ave., Grootfontein, both of South Africa

[21] Appl. No.: 105,675

[22] Filed: Dec. 20, 1979

[30] Foreign Application Priority Data

Dec. 28, 1978 [ZA] South Africa ..... 78/7361

[51] Int. Cl.[3] ..... A63B 65/00

[52] U.S. Cl. ..... 273/428; 273/423; 273/327

[58] Field of Search ..... 273/428, 413, 416, 199 A, 273/419, 420, 423, 327; 124/5

[56] References Cited

U.S. PATENT DOCUMENTS

| | | | |
|---|---|---|---|
| 442,675 | 12/1890 | Wilcox | 273/327 |
| 922,432 | 5/1909 | Jirotka | 273/327 |
| 1,793,831 | 2/1931 | Worden | 273/428 X |
| 2,213,637 | 9/1940 | Osgood | 273/420 |
| 3,049,352 | 8/1962 | Hancock | 273/327 |
| 3,437,340 | 4/1969 | Grisé | 273/199 A |
| 3,749,403 | 7/1973 | Austin et al. | 273/423 |
| 3,913,917 | 10/1975 | Coxon | 273/423 |

*Primary Examiner*—Paul E. Shapiro
*Attorney, Agent, or Firm*—Karl W. Flocks

[57] ABSTRACT

A toy, being a flighted article comprising a rod, a weight connected to one end (the head end) of the rod via a flexible element, and a flight connected to the rod in that half of the rod remote from the head-end. Optionally, an additional flight connected to that end of the rod which is remote from the head end may be provided. The toy may be propelled between opposing sides in playing a game, by pitching the toy into the air by means of a pitching rod which engages the article against the flexible element.

11 Claims, 3 Drawing Figures

TOY

This invention relates to a toy. It relates in particular to what may be termed a flighted article which may be propelled between opposing sides in playing a game.

According to the invention there is provided a flighted article comprising a rod;

a weight;

a flexible element connected to one end (referred to as the head end) of the rod and to the weight; and a flight (also referred to as the larger flight) of a manufactured material connected to the rod.

The connection of the flight to the rod may be in that half of the rod remote from the head end, and more particularly at a distance of about three-fifths to four-fifths of the length of the rod remote from the head end.

The flight may extend from its point of connection to the rod, obliquely away from the head end, the flight forming an angle with the rod, and the angle lying within the range 40° to 70°.

The flight is flexibly connected to the rod to permit the flight to lie against the rod when propelled upwards and to so provide a more streamlined projectile which may attain a greater height.

There may be provided an additional flight which may be connected to that end of the rod (the tail end) which is remote from the head end. The additional flight may lie substantially in a plane which contains or is parallel to the axis of the rod.

The surface area of the additional flight may be at the most one-fifth of the surface area of the larger flight.

The ratio of the surface area of one side of the larger flight to the total mass of the article may be about 1,000 square millimeters to one gram.

The mass of the rod and flight(s) may be about the same as that of the weight, the mass of the flexible element being negligibly small in comparison with the mass of the weight.

The flexible element may have a length which lies within the range of one-third and one-fifth the length of the rod, and is preferably of a material which is both flexible and resilient.

The rod and flight(s) may be in the form of an integral moulding of synthetic plastic material, or alternatively, the flight(s) may be adhesively secured to the rod.

The invention is now described by way of example with reference to the accompanying drawings.

Figure 1:
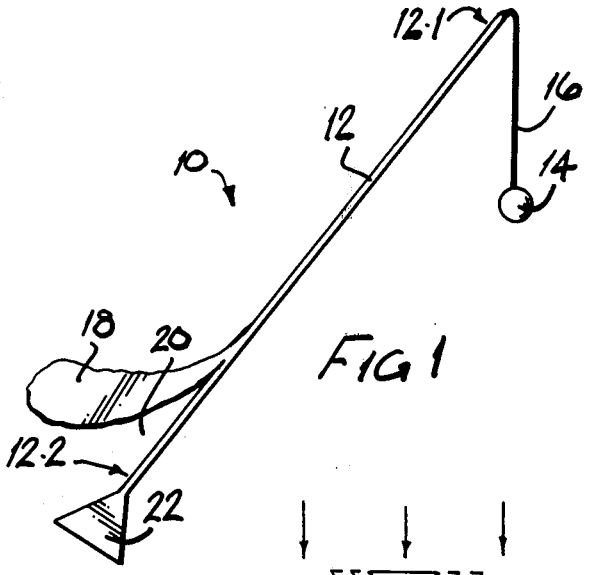
FIG. 1 shows diagrammatically a flighted article according to the invention.
Figure 2:
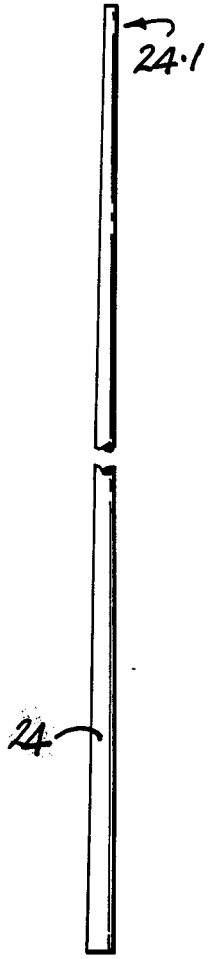
FIG. 2 shows diagrammatically a pitching rod.
Figure 3:
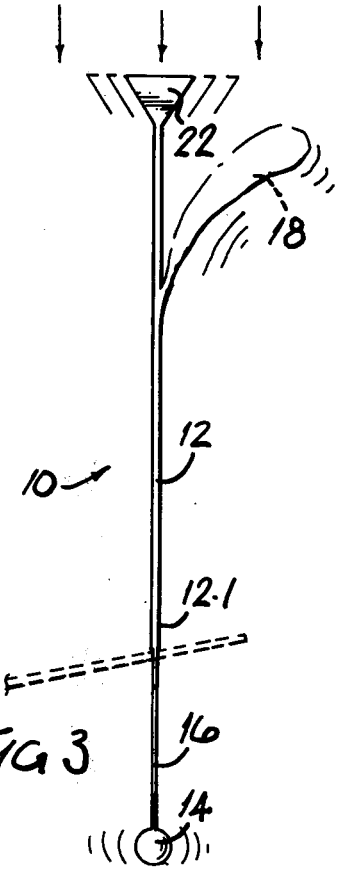
FIG. 3 shows diagrammatically the flighted article of FIG. 1 in use.

In the drawings reference numeral 10 generally indicates a flighted article according to the invention.

The article comprises a rod 12, which has fast with it at its one end 12.1 (referred to as the head end) a weight 14 via a flexible element 16. The flexible element 16 is of smaller section than the rod 12 and is flexible yet resilient. At a distance of about three quarters of the length of the rod 12 remote from the end 12.1, there is provided a first flight 18 which is the larger flight and which is assymetrically and flexibly connected to the rod 12. The first flight 18 forms an angle 20 of about 60° with the rod 12, the flight extending obliquely away from the head end 12.1. The flight 18 is slightly misaligned relative to the axis of the rod 12 so as to impart a turning motion to the article 10, when the article is falling under gravity.

At the end 12.2, (referred to as the tail end) which is remote from the head end 12.1 of the rod 12, a second flight 22, which is substantially smaller than the flight 18, is fast with the rod 12.

The combined mass of the rod 12, the flight 18 and the flight 22 substantially equals the mass of the weight 14. Resultingly, if the article is suspended from a point on the flexible element just off the head end 12.1, the article will hang in balance.

The total mass of the article is about 3½ grams, and the surface area of one side of the flight 18 is about 3,500 square millimeters, resulting in a surface area to mass ratio of about 1,000 square millimeters per gram.

The flighted article 10 is provided in integral moulded form of synthetic plastics material.

A resilient pitching rod 24 of synthetic plastics material is also provided.

In use the flighted article 10 is hooked on an end 24.1 of the pitching rod 24. The end 24.1 engages the article 10 against the flexible element 16 at a point just off the end 12.1 of the rod 12.

The article is now pitched into the air by means of the pitching rod 24. In falling, the mass 14 is below the rod. The flight 18, being slightly misaligned and asymetrical to the axis of the rod 12, imparts a turning motion to the article, which causes the article to revolve in coming slowly down.

Before the article reaches the ground, the article can be caught on the end 24.1 of the pitching rod 24 and pitched into the air again. When the article is caught on the end 24.1 of the rod 24, it is important that the flexible element should not be altogether slack. This will avoid looping around the end 24.1. The flexible element should therefore be flexible yet resilient. Alternatively, two or more persons each having a pitching rod similar to the rod 24 can pitch the article from one to another.

By way of development a plurality of persons, each having a pitching rod similar to the rod 24 can form two teams. The flighted article 10 can then be pitched from one side to the other.

We claim:

1. A flight article comprising a rod; a weight; a flexible element connected to one end (referred to as the head end) of the rod and to the weight; and a flight (also referred to as the larger flight) of a manufactured material connected to the rod, in which the ratio of the surface area of one side of the larger flight to the total mass of the article is about 1000 square millimeters to one gram.

2. A flight article comprising a rod; a weight; a flexible element connected to one end (referred to as the head end) of the rod and to the weight; and a flight (also referred to as the larger flight) of a manufactured material connected to the rod, in which the mass of the rod and the flight is about the same as that of the weight.

3. An article as claimed in claim 2, in which the mass of the flexible element is negligibly small in comparison with the mass of the weight.

4. A flight article as set forth in claim 2 in which the flexible element is resilient and has a length which lies within the range of one-third and one-fifth the length of the rod.

5. A flight article as set forth in claim 1, or claim 2, or claim 3, in which the flight is misaligned or non-aligned relative to the axis of the rod and said flight forms an angle with the axis of the rod which angle is within the range of 40°–70°.

6. A flexible article comprising a rod, a weight, a flexible element, and a flight of a manufactured material (also referred to as the larger flight), said flexible element is connected to one end (referred to as the head end) of the rod and to the weight, said flight is connected entirely asymmetrically to said rod and said flight extends from its place of connection to said rod obliquely away from the head end and is misaligned or non-aligned relative to the axis of said rod.

7. A flight article as set forth in claim 6, in which the flexible element is resilient and has a length which lies within the range of one-third and one-fifth the length of the rod.

8. A flight article as set forth in claim 6, in which the said flight forms an angle with the rod, the said angle being within the range of 40°–70°.

9. A flight article comprising a rod, a weight, a flexible element, and a flight of manufactured material (also referred to as the larger flight), said flexible element is connected to one end of said rod (referred to as the head end) and to the said weight, said flight is connected entirely asymmetrically to said rod, an additional flight connected to that end of the rod (the tail end) which is remote from the head end, said two flights are spaced apart along the axis of the rod, the spacing being between one-fifth and two-fifths of the rod length.

10. A flight article as set forth in claim 9, in which the surface area of the additional flight is at the most one-fifth of the surface area of the larger flight.

11. A flight article as set forth in claim 9, in which the flexible element is resilient and has a length which lies within the range of one-third and one-fifth of the length of the rod.

* * * * *